US009110436B2

(12) United States Patent
Asakawa et al.

(10) Patent No.: US 9,110,436 B2
(45) Date of Patent: Aug. 18, 2015

(54) IMAGE FORMING APPARATUS

(75) Inventors: Masaya Asakawa, Osaka (JP); Yasuhiro Suto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/344,174

(22) PCT Filed: Jul. 27, 2012

(86) PCT No.: PCT/JP2012/069101

§ 371 (c)(1),
(2), (4) Date: Mar. 11, 2014

(87) PCT Pub. No.: WO2013/038819

PCT Pub. Date: Mar. 21, 2013

(65) Prior Publication Data

US 2014/0341611 A1 Nov. 20, 2014

(30) Foreign Application Priority Data

Sep. 13, 2011 (JP) ..... 2011-199506

(51) Int. Cl.
*G03G 21/00* (2006.01)
*G03G 21/16* (2006.01)

(52) U.S. Cl.
CPC ..... *G03G 21/1638* (2013.01); *G03G 21/1609* (2013.01); *G03G 21/1633* (2013.01); *G03G 2215/0132* (2013.01); *G03G 2221/1639* (2013.01)

(58) Field of Classification Search
CPC ..... G03G 21/16; G03G 2215/00544; G03G 21/1609; G03G 2215/0132; G03G 21/1638
USPC ..... 399/124
See application file for complete search history.

(56) References Cited

U.S. PATENT DOCUMENTS

2002/0150403 A1 10/2002 Katsuyama et al.
2011/0044704 A1* 2/2011 Uehara ..... 399/21

FOREIGN PATENT DOCUMENTS

| | | | |
|---|---|---|---|
| JP | 2000-044086 | A | 2/2000 |
| JP | 2005-025211 | A | 1/2005 |
| JP | 2005-257994 | A | 9/2005 |
| JP | 2007-300603 | A | 11/2007 |
| JP | 2008-112180 | A | 5/2008 |
| JP | 2011-158510 | A | 8/2011 |

OTHER PUBLICATIONS

International Search Report for corresponding International Application No. PCT/JP2012/069101 mailed Aug. 28, 2012.

* cited by examiner

*Primary Examiner* — David Bolduc
*Assistant Examiner* — Barnabas Fekete
(74) *Attorney, Agent, or Firm* — Renner, Otto, Boisselle & Sklar, LLP

(57) ABSTRACT

An image forming apparatus (100) includes: a side cover (201) mounted on a side part of an apparatus body to be freely opened and closed; a fixing portion (80) mounted inside the apparatus body and close to the side cover (201) and fixing an image to a paper sheet P fed in a direction from a bottom to a top of the apparatus body; and a document platen (130) mounted at an upper part of the apparatus body and supporting a document placed thereon. The document platen (130) includes a cutout portion (130K) formed in a manner such that a portion opposed to an upper part of the side cover (201) is cut out inside; and the fixing portion (80) includes a nip (85) that, when the side cover (201) is opened, can be viewed obliquely from a lateral upper side of the apparatus body through the cutout portion (130K).

7 Claims, 5 Drawing Sheets

IMAGE FORMING APPARATUS

TECHNICAL FIELD

The present invention relates to an image forming apparatus equipped with a side cover capable of being freely opened and closed in a side part of an apparatus body.

BACKGROUND ART

An image forming apparatus, if a paper jam (paper jamming) occurs during image formation, senses the paper jam by a sensor and stops feeding a paper sheet. At this time, a user needs to open a side cover mounted on the side part of an apparatus body, check the inside of the apparatus, and remove a jammed paper sheet.

Conventionally, an image forming apparatus excellent in visibility of a situation or removal performance of a jammed paper sheet when a paper jam has occurred at or near a fixing portion has been disclosed (see Patent Literature 1, for example). In the image forming apparatus disclosed in Patent Literature 1, a lever is operated to cause a guide member to be largely displaced by rotation, which releases a nip that a heating roller and a pressurizing roller contact. Thus, when a paper jam occurs at the fixing portion, the visibility of the state of a paper sheet is enhanced and a jammed paper becomes easier to be removed.

CITATION LIST

Patent Literature

Patent Literature 1: Japanese Patent Laid-Open publication No. 2005-257994

SUMMARY OF INVENTION

Technical Problem

However, the conventional image forming apparatus has had the following limitations.

1. The range of the installation height of an image reading portion has been limited in order to enable a user to easily place a document on the image reading portion.

2. The apparatus body provided with an image forming portion and a sheet feed portion (paper storage portion) and the image reading portion mounted at the upper part of the apparatus body have needed to have the same width in order to improve the balance of appearance.

3. The spacing between the components mounted in the apparatus needed to be made narrower in order to meet the needs of miniaturization. In particular, in a case of the image forming apparatus of the inner body output type, as described in Patent Literature 1, a space for a paper output tray is provided between the image forming portion and the image reading portion (image input portion), so that a space in the apparatus body is narrow. Therefore, for example, the fixing portion of the image forming portion needed to be arranged immediately under the image reading portion to make the spacing with the image reading portion as narrow as possible.

Since the conventional image forming apparatus has such structural limitations, a user, when checking the state of a paper jam by opening the cover of the image forming apparatus, had to check from the lateral side of the apparatus, that is, from the limited direction. In addition, since the spacing in the apparatus is narrow, it has been hard to check the inside of the apparatus. This caused a problem that a place in which a paper jam has occurred was hard to be found.

Accordingly, it is an object of the present invention to provide an image forming apparatus in which the inside of an apparatus body can be easily checked and a place in which a paper jam has occurred can be easily found.

Solution to Problem

An image forming apparatus of the present invention is equipped with a side cover, a fixing portion, and a document platen. The side cover is mounted on a side part of an apparatus body so as to be freely opened and closed. The fixing portion is mounted at a position inside the apparatus body and close to the side cover and fixes an image to a recording medium fed in a direction from a bottom to a top of the apparatus body. The document platen is mounted at an upper part of the apparatus body and a document is placed thereon. The document platen includes a cutout portion formed in a manner such that a portion opposed to an upper part of the side cover is cut out inside and the fixing portion includes a nip that, at a time of opening of the side cover, can be viewed obliquely from a lateral upper side of the apparatus body through the cutout portion.

According to the present invention, a user, when opening a cover, can check the nip of the fixing portion mounted in the apparatus body from the lateral upper side of the apparatus body through the cutout portion. Therefore, a paper jam occurred in the fixing portion can be easily found. In particular, a paper sheet wrapped around a pressurizing roller or a heating roller, which is hard to be found by checking from the lateral side, can be reliably found. This can promptly remove a jammed paper sheet. Moreover, the shape of the document platen is only changed into a shape in which a part of an end is cut, so that there is almost no influence due to shape change, and an image on a document can be read without any problems.

According to the present invention, the cutout portion may only have a shape in which the nip of the fixing portion can be viewed obliquely from the lateral upper side of the apparatus body and, for example, may be an inclined surface or and a stepped surface. Since the shapes are simple, processing is easy.

According to the present invention, the cover, at a time of closure, may preferably cover the cutout portion.

With this structure, in a state in which the cover is closed, the cutout portion is not exposed to the side part of the apparatus body. Accordingly, the apparatus can have a simple appearance.

According to the present invention, the image forming apparatus may preferably include a vertical feed path. The vertical feed path is mounted at a position inside the apparatus body and close to the side cover, used to feed the recording medium to the fixing portion in a direction from the bottom to the top, and arranged, at a time of opening of the side cover, so as to be viewed obliquely from the lateral upper side of the apparatus body through the cutout portion.

With this structure, when the cover is opened, the vertical feed path can be checked through the cutout portion. Therefore, a user, when a paper jam has occurred, can check the state of the vertical feed path from the lateral upper part or the lateral side of the apparatus body and find a place in which the paper jam has occurred.

According to the present invention, the fixing portion, and an inner body output space to which the recording medium to which the fixing portion fixes an image is output may preferably be located immediately under the document platen in this order with reference to a position of the side cover.

According to the present invention, since, because of the inner body output space, the space in the apparatus body is narrow and the fixing portion is located immediately under the document platen, the cutout portion is provided even if the spacing between the document platen and the fixing portion is narrow, so that the nip of the fixing portion can be checked through the cutout portion. Thus, even when the image forming apparatus is an inner body output type or the apparatus is miniaturized, it is easy to check the inside of the apparatus body and it is possible to easily find a place in which a paper jam has occurred.

Advantageous Effects of Invention

The present invention makes it easy to check the inside of an apparatus body and makes it possible to easily find a place in which a paper jam has occurred.

BRIEF DESCRIPTION OF DRAWINGS

FIG. 1A illustrates a state in which a side cover is closed. FIG. 1B illustrates a state in which a side cover is opened.

FIG. 3A illustrates a case in which the image reading portion includes no cutout portion. FIG. 3B illustrates a case in which the image reading portion includes the cutout portion.

DESCRIPTION OF EMBODIMENT

Figure 1A:
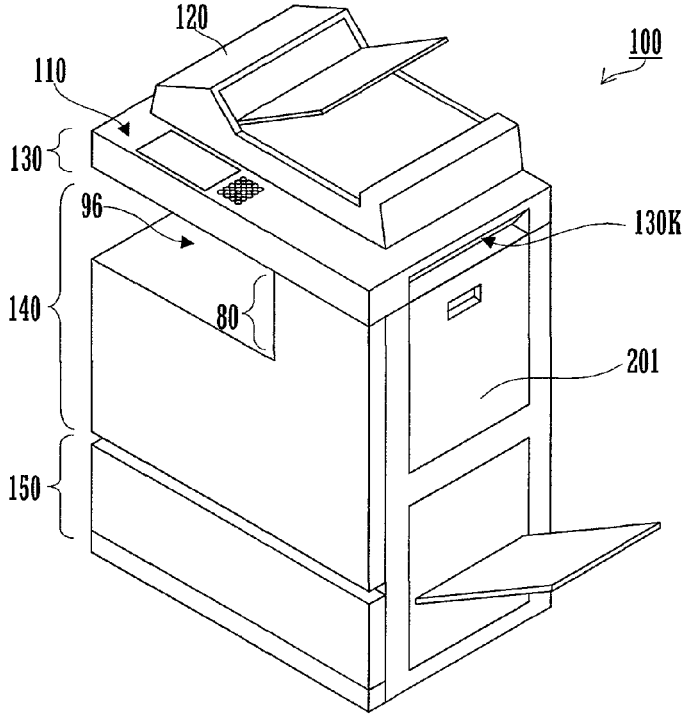
FIG. 1A and FIG. 1B are perspective external views of an image forming apparatus according to a preferred embodiment of the present invention.
Figure 1B:
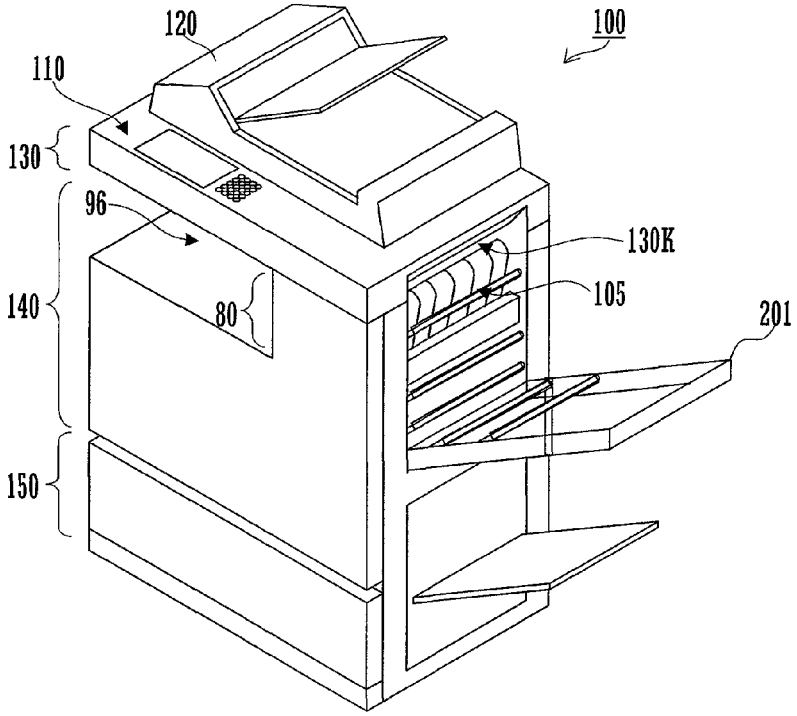

As illustrated in FIG. 1A and FIG. 1B, an image forming apparatus 100 is equipped with an image reading portion 130 at the upper part of an apparatus body. The image reading portion 130 is equivalent to the document platen and equipped with a first document platen 131 and a second document platen 132, as will be described later. Above the image reading portion 130, a panel unit 110 and an automatic document feeding portion 120 are mounted. The panel unit 110 is equipped with a display portion and an operating portion. The image forming apparatus 100 is equipped with an image forming portion 140 and a sheet feed portion 150 within the apparatus body.

The image forming apparatus 100 is equipped with a side cover 201 on the right lateral side as the side part of the apparatus body. The side cover 201 is supported by a shaft 202 mounted in the lower end on both lateral sides and can be freely opened and closed (see FIG. 2). As illustrated in FIG. 1B, on the right lateral side of the apparatus body, an opening portion 105 is provided and the side cover 201, as illustrated in FIG. 1A, covers the opening portion 105 in a closed state (at a time of closure).

The image forming apparatus 100 is an inner body output type and, immediately under the image reading portion, includes a fixing portion 80, and an inner body output space 96 to which a paper sheet (recording medium) to which the fixing portion 80 fixes an image is output. The fixing portion 80 and the inner body output space 96 are arranged in this order with reference to a position of the side cover 201.

The display portion of the panel unit 110 displays the state of the image forming apparatus 100, a status of a current print job, and the like. The panel unit 110 includes an operating portion that receives an operation of a user. The user can use the image forming apparatus 100 to perform print jobs such as copy, print, and scan and reading jobs by operating the operating portion.

Figure 2:
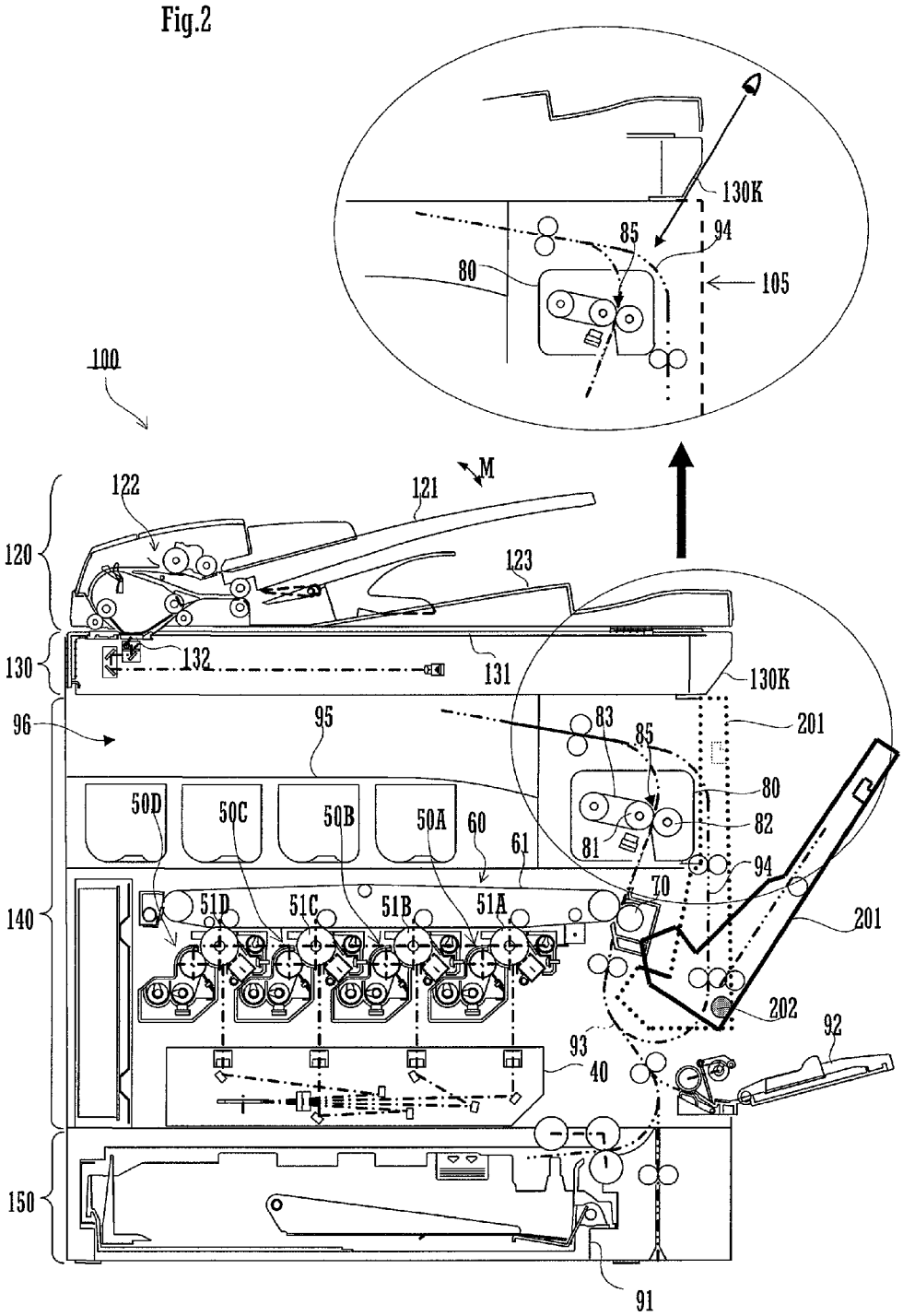
FIG. 2 is a front perspective view illustrating an internal structure of the image forming apparatus, with an enlarged view of a cutout portion.

The image reading portion 130 has a box shape and the same width as the apparatus body. At a portion located on the right side end of the image reading portion 130 and opposed to an upper part of the side cover 201, a cutout portion 130K having an inside cutout shape is provided. FIG. 1A, FIG. 1B, and FIG. 2 illustrate, as an example, the cutout portion 130K processed into an inclined surface.

As illustrated in FIG. 2, the automatic document feeding portion 120, when the operating portion receives a fed document reading mode, feeds documents placed on a document load tray 121 one by one to a document output tray 123 by way of the second document platen 132 by a feeding unit 122.

The image reading portion 130, when the operating portion receives the fed document reading mode, reads an image on each document passing on the second document platen 132 and generates print image data. The image reading portion 130, when the operating portion receives a fixed document reading mode, also reads a document placed on the first document platen 131 and generates print image data. The print image data is transmitted from the image reading portion 130 to the image forming portion 140.

The image forming portion 140 is equipped with: a light scanning unit 40; four image forming stations 50A, 50B, 50C, and 50D; an intermediate transfer belt unit 60; a secondary transfer roller 70; a fixing portion 80; and a paper output tray 95. The image forming stations 50A to 50D are aligned along a travel path of an intermediate transfer belt 61 of the intermediate transfer belt unit 60.

The print image data that the image reading portion 130 reads is divided into print image data of four colors of black, cyan, magenta and yellow and transmitted to the light scanning unit 40. The light scanning unit 40 individually irradiates photoreceptor drums 51A, 51B, 51C, and 51D of the image forming stations 50A to 50D with laser beams modulated according to the print image data of the four colors. Accordingly, on each of the peripheral surfaces of the four photoreceptor drums 51A to 51D, an electrostatic latent image is formed based on the print image data of each color of black, cyan, magenta, and yellow.

The image forming stations 50A to 50D supply toners (developers) of black, cyan, magenta, and yellow to the electrostatic latent image formed on each of the photoreceptor drums 51A to 51D, thus making the electrostatic latent image visible as a toner image.

In the image forming stations 50A to 50D, the toner images of each color formed on each of the photoreceptor drums 51A to 51D are primarily transferred onto the outer peripheral surface of the intermediate transfer belt 61 so as to be superimposed upon one another, thereby making a full color toner image born on the outer peripheral surface of the intermediate transfer belt 61.

It is to be noted that when only black image data is input, a black toner image is primarily transferred onto the outer peripheral surface of the intermediate transfer belt 61.

The toner image that has primarily been transferred onto the outer peripheral surface of the intermediate transfer belt 61 is fed by rotation of the intermediate transfer belt 61 to a secondary transfer position at which the intermediate transfer belt 61 and the secondary transfer roller 70 are opposed to each other.

The sheet feed portion 150 is equipped with a sheet feed tray 91, a manual feed tray 92, a first sheet feed path 93 as a vertical feed path, and a second sheet feed path 94 as a vertical feed path. Each of the sheet feed tray 91 and the manual feed tray 92 stores plain paper, photographic paper, and a recording medium such as an OHP film. Hereinafter, the recording medium is also referred to as a paper sheet.

The first sheet feed path 93 feeds a paper sheet in the direction from the lower part to the upper part of the image forming apparatus 100 body. Specifically, the first sheet feed path 93 is formed so as to reach the paper output tray 95 from each of the sheet feed tray 91 and the manual feed tray 92 by way of the secondary transfer position and the fixing portion 80. The second sheet feed path 94, which is a sheet feed path for duplex printing, is formed from the upper part to the lower part of the image forming apparatus 100 body, in such a manner that a paper sheet of which a surface on one side has an image formed on the surface is again fed, in an overturned state, to the secondary transfer position. A plurality of feed rollers are attached to the first sheet feed path 93 and the second sheet feed path 94 at a predetermined interval.

The toner image that has primarily been transferred onto the outer peripheral surface of the intermediate transfer belt 61, when a paper sheet fed from the sheet feed portion 150 is fed by way of the secondary transfer position, is secondarily transferred onto the paper sheet. The paper sheet onto which the toner image has been transferred is fed to the fixing portion 80 through the first sheet feed path 93, or the second sheet feed path 94 and the first sheet feed path 93. The second sheet feed path 94 is mounted at a position close to the side cover 201 that covers the opening portion 105.

The fixing portion 80 is connected to the first sheet feed path 93, and, in the same manner as the first sheet feed path 93, feeds a paper sheet in the direction from the lower part to the upper part of the image forming apparatus 100 body. The fixing portion 80 is mounted at a position close to the side cover 201 that covers the opening portion 105. The fixing portion 80 heats and pressurizes the paper sheet that passes a gap between the heating roller 81 and the pressurizing roller 82, that is, a nip 85, thereby fixing the toner image to the surface of the paper sheet. The fixing portion 80 includes an external heating belt 83 for heating the heating roller 81 from the outside.

Since the fixing portion 80 is arranged immediately under the image reading portion 130, the spacing between the image reading portion 130 and the fixing portion 80 is very narrow. Therefore, the first sheet feed path 93 and the second sheet feed path 94 bend by about 90 degrees in the upper part of the fixing portion 80 and are arranged along the bottom of the image reading portion 130. The paper sheet onto which the fixing portion 80 fixed the toner image is output to the paper output tray 95 provided in the inner body output space 96.

In the case in which a paper jam has occurred in the image forming apparatus 100, a user, by manually pulling a handle of the side cover 201, opens the side cover 201 and can check the status in the apparatus body. When the user opens the side cover 201, the fixing portion 80 of the image forming portion 140 and the second sheet feed path 94 are exposed through the opening portion 105.

As previously described, at the portion located in the image reading portion 130 and opposed to the upper part of the side cover 201, the cutout portion 130K having an inside cutout shape is provided. In addition, as described above, the fixing portion 80 and the second sheet feed path 94 are arranged close to the side cover 201 that covers the opening portion 105. Therefore, a user, when opening the side cover 201 (at a time of opening), can visually check the fixing portion 80 and a bent portion of the second sheet feed path 94 through this cutout portion 130K with an oblique view from the lateral upper side of the body of the image forming apparatus 100. Moreover, the opening of a housing of the fixing portion 80 makes it possible to visually check the nip 85 of the fixing portion 80. Furthermore, the opening of the side cover 201 (at a time of opening), as in the conventional art, also makes it possible to visually check the inside of the apparatus body from the side of the apparatus body. It should be noted that, in the enlarged view of the cutout portion of FIG. 2, the opening portion 105 is illustrated by a dotted line.

The difference by the presence of the cutout portion is specifically as follows. The following describes a case in which the housing 86 of the fixing portion 80 is opened to check the nip 85, as an example.

Figure 3A:
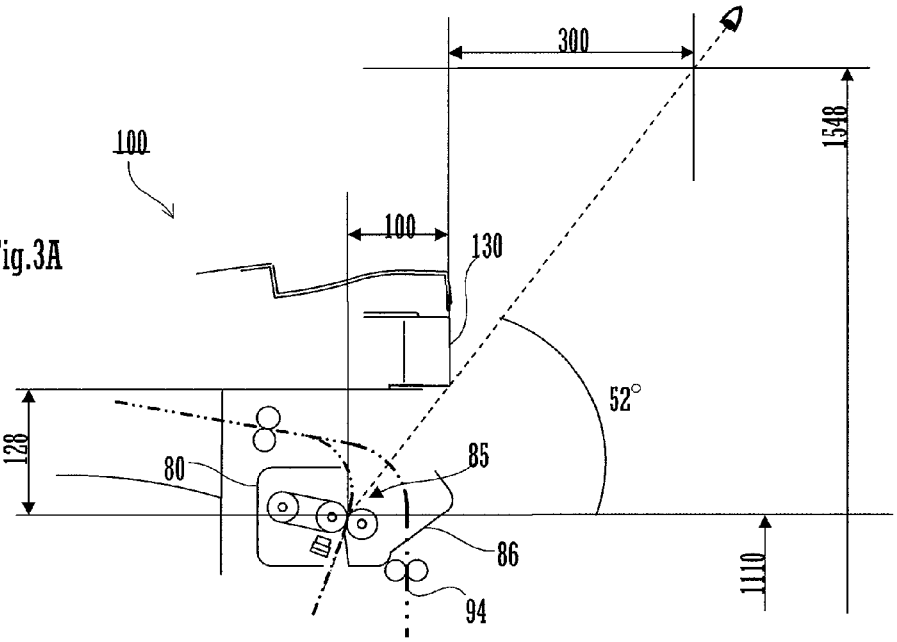
FIG. 3A and FIG. 3B are enlarged views of a right end of an image reading portion, a fixing portion, and an opening portion.
Figure 3B:
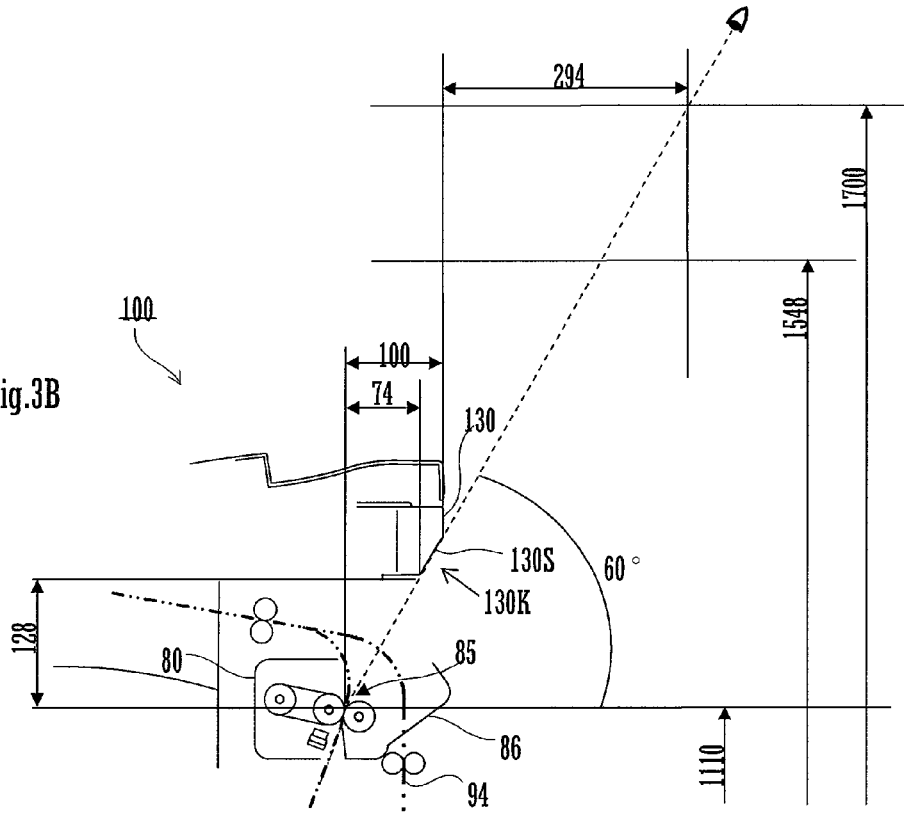

As illustrated in FIG. 3A and FIG. 3B, the distance between the nip 85 of the fixing portion 80 and the right lateral side of the image forming apparatus 100 body is set to 100 mm whereas the distance between the nip 85 and the bottom of the image reading portion 130 is set to 128 mm. The height of the nip 85 from a floor surface is set to 1110 mm. As illustrated in FIG. 3B, when the cutout portion 130K is provided, the distance between the nip 85 of the fixing portion 80 and the lower end of the cutout portion 130K is set to 74 mm. The angle to the horizontal line of the inclined surface 130S is 60 degrees as an example.

As illustrated in FIG. 3A, when the cutout portion 130K is not provided, the angle formed by the horizontal line passing the nip 85 and a straight line connecting the nip 85 and the right lower end of the image reading portion 130 is 52 degrees. In such a case, the user, when checking the nip 85 from a position about 300 mm away in the horizontal direction from the lateral side of the image forming apparatus 100, needs to set the position of the eyes to a height of 1548 mm from the floor surface.

By contrast, as illustrated in FIG. 3B, when the cutout portion 130K is provided, the angle formed by the horizontal line passing the nip 85 and a straight line connecting the nip 85 and the lower end of the cutout portion 130K is 60 degrees. In such a case, the user, when checking the nip 85 from a position 294 mm away in the horizontal direction from the lateral side of the image forming apparatus 100, may set the position of the eyes to a height of about 1700 mm from the floor surface.

Thus, when the cutout portion 130K is provided on the right end of the image reading portion 130, as compared with a case in which the cutout portion 130K is not provided, the height of the eyes of the user can be raised by about 150 mm. In other words, the user can check the nip 85 from the lateral upper side of the body of the image forming apparatus 100, without lowering the eye level. Accordingly, when a paper jam has occurred in the fixing portion 80, a jammed paper sheet can be reliably found. For example, when a paper jam occurs and a paper sheet is wrapped around the heating roller 81 or the pressurizing roller 82 of the fixing portion 80, it is hard to find the paper sheet wrapped around the roller only by checking from the lateral side. However, since the heating roller 81, the pressurizing roller 82, and the nip 85 can be checked from the lateral upper side of the apparatus body, the paper sheet wrapped around the roller can be reliably found.

In addition, the user can also check the second sheet feed path 94 from the lateral upper side of the body of the image forming apparatus 100 from a standing position, without bending down to lower the eye level as in the conventional art.

It is to be noted that, when the side surface of the image reading portion 130 is processed into an inclined surface, an inclined angle of the inclined surface may preferably be set in accordance with conditions such as the position of the nip 85, the size of the apparatus body of the image forming apparatus 100, and the height of a user (eye height).

Moreover, when the side surface is processed into an inclined surface as the cutout portion 130K, the shape is simple and processing is easy.

Figure 4:
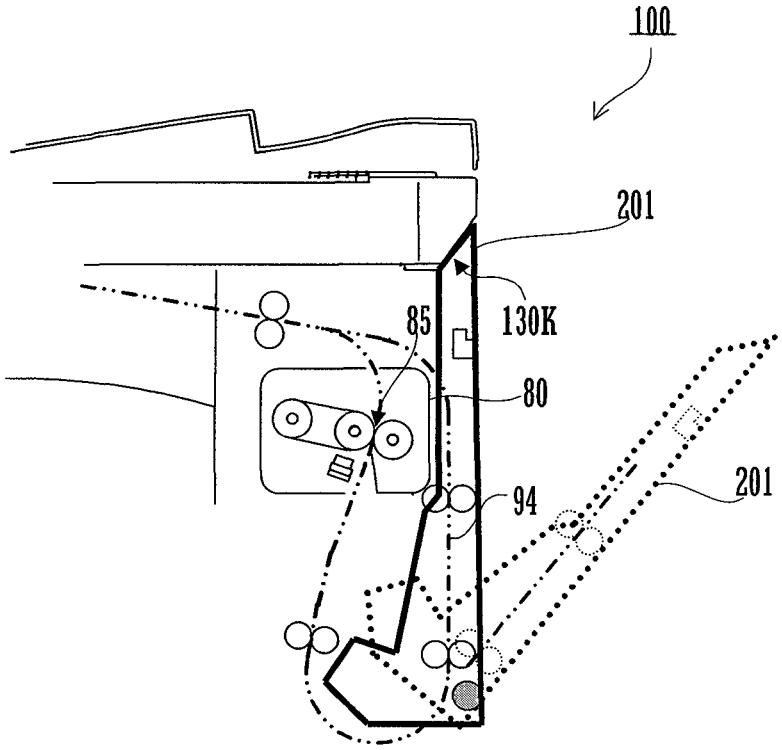
FIG. 4 is an enlarged view illustrating a cutout portion processed into an inclined surface, and a cover that covers the cutout portion.

As illustrated in FIG. 4, in order that the cutout portion 130K is not exposed to the outside when the side cover 201 is closed (at a time of closure), the upper end of the side cover 201 may be extended further to the upper part to cover the cutout portion 130K with the side cover 201. Accordingly, in a state in which the side cover 201 is closed, the cutout portion 130K is not exposed to the lateral side of the image forming apparatus 100, so that the appearance of the apparatus body can be made into a simple shape (design).

Figure 5A:
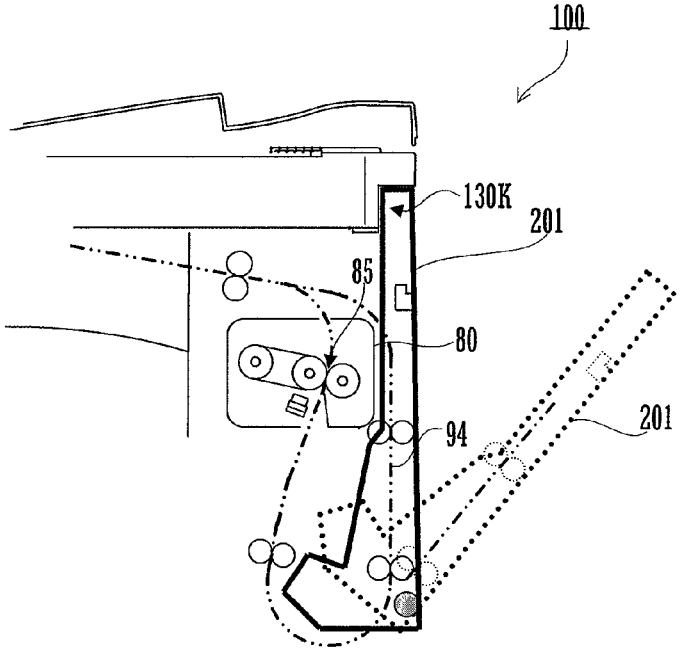
FIG. 5A is an enlarged view illustrating a cutout portion processed into a stepped surface, and a cover that covers the cutout portion.
Figure 5B:
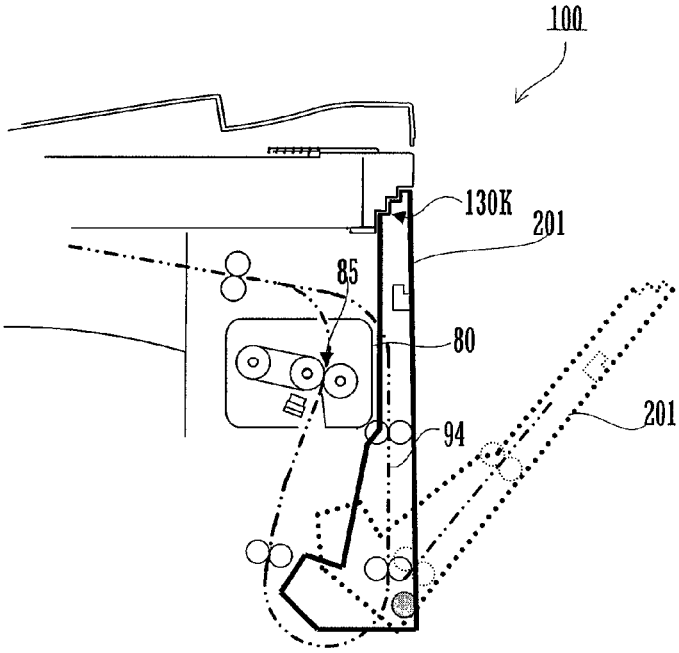
FIG. 5B is an enlarged view illustrating a cutout portion processed into a staircase shape, and a cover that covers the cutout portion.

The shape of the cutout portion 130K provided on the side end of the image reading portion 130 is not limited to an inclined surface and may be of other shapes as long as the shape is a shape in which the second sheet feed path 94 and the fixing portion 80, when the side cover 201 is opened, can be checked from an upper part or an oblique upper part. For example, as illustrated in FIG. 5A, the side surface of the image reading portion 130 may be processed into a stepped surface. Alternatively, as illustrated in FIG. 5B, the side surface may be processed into a staircase shape in which a plurality of stepped surfaces are provided.

As described above, in the apparatus body of the image forming apparatus 100, the cutout portion 130K provided in a portion located in the image reading portion and opposed to the upper part of the side cover makes it possible to check the inside of the apparatus body from the lateral upper side or the lateral side. Accordingly, when a paper jam has occurred, a jammed paper sheet can be reliably found.

It should be noted that, while the side cover 201 has a structure in which the lower end is supported pivotally, the structure is not limited to this and may be a structure in which the inside of the apparatus body can be visually checked through the cutout portion when the side cover is opened. For example, the right end or the left end may be structured to be supported pivotally.

Furthermore, while the forgoing description has been directed to the inner body output type image forming apparatus as an example, the type is not limited to this and may be other types as long as an image forming apparatus includes an image reading portion on a top face of a casing. For example, the image forming apparatus may be of a type in which a paper sheet on which an image is fixed is output to a paper output tray provided on a lateral part of the apparatus body.

REFERENCE SIGNS LIST

80 Fixing portion
81 Heating roller
82 Pressurizing roller
85 Nip
93 First paper feed path
94 Second paper feed path
96 Inner body output space
100 Image forming apparatus
105 Opening portion
130 Image reading portion
130K Cutout portion
140 Image forming portion
201 Side cover

The invention claimed is:

1. An image forming apparatus comprising:

a side cover mounted on a part of a side face of an apparatus body so as to freely open and close at least a part of a sheet feed path inside the apparatus body; and a fixing portion mounted at a position inside the apparatus body and close to the side cover and including a nip fixing an image to a recording medium fed in the sheet feed path, wherein:

the side face includes an upper edge of an opening portion that is opened when the side cover is opened, the upper edge being positioned above a line connecting the nip and an outside upper part of the side face so as to enable the nip to be viewed from the outside upper part of the side face when the side cover is opened;

the upper edge is positioned on an inner side of the apparatus body from a portion excluding the opening portion of the side face;

a cutout portion is provided between the portion excluding the opening portion of the side face and the upper edge; and the cutout portion is an inclined surface of which a lower side is positioned on the inner side of the apparatus body from an upper side of the inclined surface.

2. An image forming apparatus, comprising:

a side cover mounted on a part of a side face of an apparatus body so as to freely open and close at least a part of a sheet feed path inside the apparatus body; and a fixing portion mounted at a position inside the apparatus body and close to the side cover and including a nip fixing an image to a recording medium fed in the sheet feed path, wherein:

the side face includes an upper edge of an opening portion that is opened when the side cover is opened, the upper edge being positioned above a line connecting the nip and an outside upper part of the side face so as to enable the nip to be viewed from the outside upper part of the side face when the side cover is opened;

the upper edge is positioned on an inner side of the apparatus body from a portion excluding the opening portion of the side face;

a cutout portion is provided between the portion excluding the opening portion of the side face and the upper edge;

the upper edge, and a lower end of the cutout portion are vertically spaced apart from each other; and the cutout portion is an inclined surface of which a lower side is positioned on the inner side of the apparatus body from an upper side of the inclined surface.

3. An image forming apparatus comprising:

a side cover mounted on a part of a side face of an apparatus body so as to freely open and close at least a part of a sheet feed path inside the apparatus body; and a fixing portion mounted at a position inside the apparatus body and close to the side cover and including a nip fixing an image to a recording medium fed in the sheet feed path, wherein:

the side face includes an upper edge of an opening portion that is opened when the side cover is opened, the upper edge being positioned above a line connecting the nip and an outside upper part of the side face so as to enable the nip to be viewed from the outside upper part of the side face when the side cover is opened;

the upper edge is positioned on an inner side of the apparatus body from a portion excluding the opening portion of the side face;

a cutout portion is provided between the portion excluding the opening portion of the side face and the upper edge; and the cutout portion is a stepped surface of which a lower side is positioned on the inner side of the apparatus body from an upper side of the stepped surface.

4. The image forming apparatus according to claim 1, wherein the side cover, when closed, covers the cutout portion.

5. The image forming apparatus according to claim 2, wherein the side cover, when closed, covers the cutout portion.

6. The image forming apparatus according to claim 3, wherein the side cover, when closed, covers the cutout portion.

7. The image forming apparatus according to claim 3, wherein a shape of the cutout portion is a surface having a staircase shape in which a plurality of stepped surfaces are provided.

* * * * *